United States Patent [19]

Janusch et al.

[11] Patent Number: 4,628,619

[45] Date of Patent: Dec. 16, 1986

[54] DRYING PLANT FOR BROWN COALS OF HIGH WATER CONTENT

[75] Inventors: Alois Janusch, Leoben; Franz W. Mayer, Proleb; Gero Tessmer, Linz, all of Austria

[73] Assignee: Voest-Alpine Aktiengesellschaft, Linz, Austria

[21] Appl. No.: 709,820

[22] Filed: Mar. 8, 1985

[30] Foreign Application Priority Data

Mar. 21, 1984 [AT] Austria ..... 950/84

[51] Int. Cl.[4] ..... F26B 17/20

[52] U.S. Cl. ..... 34/180; 34/9; 34/15; 34/181; 34/242

[58] Field of Search ..... 34/9, 15, 179, 180, 34/181, 242, 86

[56] References Cited

U.S. PATENT DOCUMENTS

| | | | |
|---|---|---|---|
| 2,264,390 | 12/1941 | Levine et al. | 34/180 |
| 3,007,254 | 11/1961 | Schuster | 34/15 |
| 3,552,031 | 1/1971 | Evans et al. | 34/9 |
| 4,179,043 | 12/1979 | Fischer | 34/242 |
| 4,466,199 | 8/1984 | Nakabayashi et al. | 34/9 |
| 4,502,227 | 3/1985 | Janosch | 34/15 |
| 4,514,910 | 5/1985 | Elmore et al. | 34/15 |
| 4,536,969 | 8/1985 | Sherman | 34/9 |

*Primary Examiner*—Albert J. Makay
*Assistant Examiner*—David W. Westphal
*Attorney, Agent, or Firm*—Cushman, Darby & Cushman

[57] ABSTRACT

A drying plant for brown coals of high water content comprises, as seen in flow direction of the coal and one behind the other, a conveyor means (2) equipped with a means (3) for spraying hot waste water onto the coal, a wet sieve (4) equipped with a means (5) for supplying residual steam, a conveyor means (6) for conveying the sieved material to a pressure lock (7), a preheating means (8) equipped with a pressure lock (7) at the charging location and with connections for steam conduits (11), a further pressure lock (13) for discharging the coal from the preheating means (8) and for charging the coal into an autoclave (14) being adapted for being supplied with steam, preferably saturated steam, and having connected thereto waste water conduits (12), a sieve drum (15) arranged within the autoclave (14) and being equipped with a variable rotational drive means (16) and with conveyor elements, in particular screw conveyor elements, a further pressure lock (19) for discharging the steamed material into a subsequent drying means (20), a subsequent drying means (20) having a connection (22) for preheated gases such as steam, air or inert gases, and a means (23) for transporting away the dry coal.

6 Claims, 1 Drawing Figure

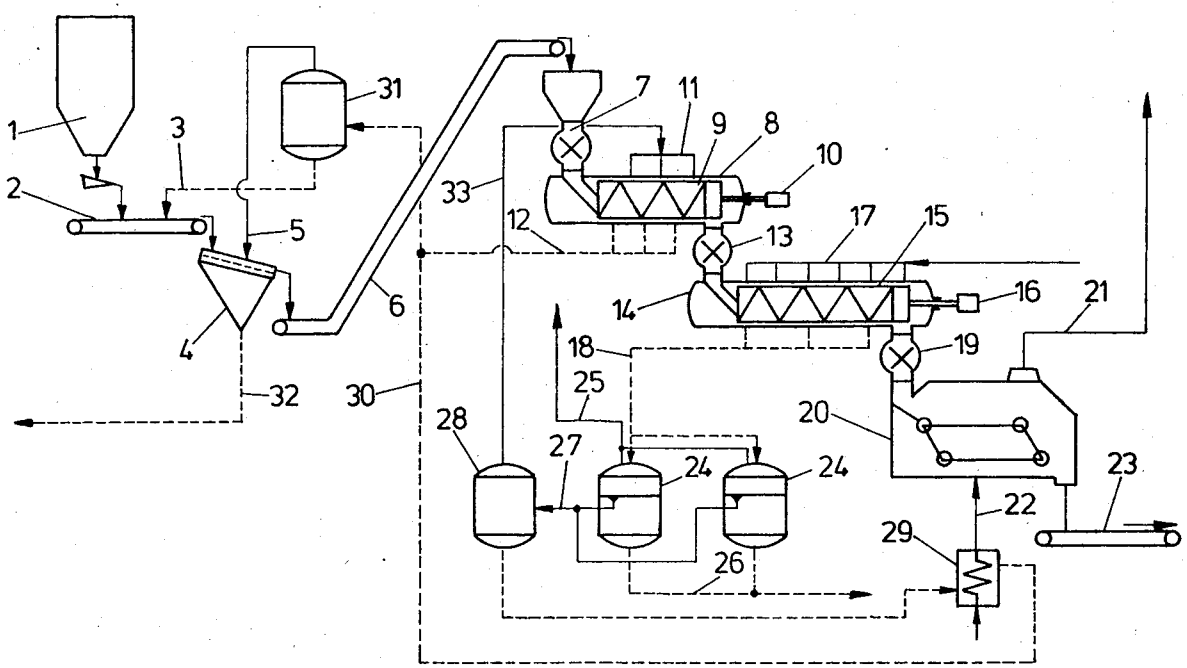
1
2
3
4
5
6
7
8
9
10
11
12
13
14
15
16
17
18
19
20
21
22
23
24
24
25
26
27
28
29
30
31
32
33

DRYING PLANT FOR BROWN COALS OF HIGH WATER CONTENT

The invention refers to a drying plant for brown coals of high water content, in which plant the coal to be dried is preheated, is steamed by using steam under super-atmospheric pressure and is redried.

For drying brown coals of high water content, it has already been proposed to treat the coals to be dried by means of saturated steam, this treatment resulting in the destruction of the colloidal structure of the brown coal and simultaneously in a shrinkage of the brown coal with accompanying reduction of the viscosity of the water and with enhancing of expelling of the water contained within the capillar structure of the brown coal. The very first plants for performing such a process, which has become known as the so-called Fleissner-process, comprised autoclaves which were discontinuously charged with brown coal and were cyclically supplied with saturated steam. After a pressure-relief of the respective autoclave containing the coal having just been steamed, the substantially dried coal could be discharged.

Further, proposals had become known for continuously or semi-continuously operating this process which originally was performed in a discontinuous manner. For this purpose, there have already been proposed sieve drums operated under the pressure of saturated steam and which allow to discharge the water obtained during the process already at an early process stage and which avoid any completely unnecessary heating of this water representing only a ballast.

The present invention now aims at proposing a complete drying plant, in which a number of component parts known per se is used and which can, however, be adapted without substantial modifications to different throughputs per unit of time and this with extremely low energy costs. In this case, the starting material used is granular brown coal of a granulometry within the range of 0.1 to 14 mm and it is intended to obtain a high degree of drying with an only low specific energy requirement. For solving this task, the invention is essentially characterized by the combination of the following component parts:

(a) a conveyor means, preferably a vibrating trough, equipped with a means for spraying hot waste water over the coal, (b) a wet sieve, in particular a vibrating sieve, equipped with a means for supplying residual steam, (c) a conveyor means, in particular a steep conveyor belt, for transporting the material having been sieved to a pressure lock, (d) a preheating means equipped with a pressure lock at the charging location and with connexions for steam conduits, the preheating means and the pressure lock preferably being equipped with infinitely variable drive means, (e) a further pressure lock, preferably being equally designed for being infinitely variable, for discharging the coal from the preheating means and for charging the coal into an autoclave designed for being supplied with steam, preferably saturated steam, and having connected thereto, optionally via pressure valves, waste water conduits, (f) a sieve drum arranged within the autoclave and comprising a preferably infinitely variable rotational drive means and comprising conveying elements, in particular screw conveyor elements, (g) a further, preferably infinitely variable pressure lock for discharging the steamed material into a subsequent drying means, (h) a subsequent drying means, preferably a vibrating drying means, comprising a connexion for preheated gases such as steam, air or inert gases, and a means for transporting away the dry coal.

The first conveying means, which is directly connected with a storage bunker for the coal to be dried and which is preferably designed as a vibrating trough, provides in a simple manner the possibility to directly spray over the coal the hot waste water coming from the subsequent drying stage and thus to preheat the coal. In this manner, the residual heat of the process is utilized and the load of the receiving stream by the waste water is reduced, because waste water coming from the process is passed along a closed circuit. The subsequent wet sieve serves, in an advantageous manner, the purpose of removing the residual amount of fine coal grains and of removing adhering dust, noting that also in this case the coal is additionally preheated with residual steam coming from the waste water. The subsequent conveyor means, which is preferably designed as a steep conveyor belt, provides the possibility to supply in a space-saving manner the preheated raw brown coal without any substantial temperature loss to a preheating means being, according to the invention, equipped with a pressure lock at the charging location and with connexions for steam conduits. Further preheating of the material to be dewatered by means of steam becomes thus possible within this preheating means and, on account of a direct connection between the preheating means and the autoclave being established via a further pressure lock at the discharge location of the preheating means and the charging location of an autoclave to be supplied with saturated steam, there is provided the possibility to transfer the coal into the autoclave in an energy-saving manner. The pressure lock between the preheating means and the autoclave further provides the additional possibility to utilize the waste steam coming from the pressure lock for direct preheating of the material to be dried. Waste water conduits are, according to the invention, connected to the autoclave to be subjected to saturated steam via pressure valves, through which the expelled process water can be discharged, so that this process water need not be further heated. For reliably separating the process water to a great extent, a sieve drum comprising a rotational drive means is arranged within the autoclave. The preheating means and the autoclave can be operated under a super-atmospheric pressure, so that the material to be dried and directly introduced into the drying stage within the autoclave is a material which has been pretreated in an optimum manner for being dried by means of saturated steam. The autoclave is followed by a further pressure lock for discharging the steamed material and for pressure-relieving this material, and a subsequent drying means is provided within which part of the residual amount of water is evaporated at atmospheric pressure on account of the latent heat, drying being enhanced by introducing hot air. The subsequent drying means is preferably designed as a vibrating drying means and has a connexion for preheated air, and the whole is then followed by a usual means for transporting away the dry coal. Cooling and/or inertizing of the product can additionally be effected within the subsequent drying means.

This inventive arrangement of the individual components of the plant provides the possibility to guide both the waste water and the steam along a closed circuit and also to recover to a great extent heat energy during the drying process to be performed within the drying plant. For this purpose, the waste water conduits coming from autoclaves preferably are connected to appending receptacles to which are connected discharge conduits for $CO_2$, for waste water and for sludge as well as a conduit leading to a pressure-relief receptacle. The appending receptacles serve, beside the purpose of separating the $CO_2$ generated during drying the coal by means of saturated steam, also the purpose of pre-separating solid matter contained within the waste water, and the waste water collected within the appending receptacle can immediately be supplied to a heat exchanger for preheating air and can be used to be sprayed onto the material to be dried with simultaneous separation of residual steam. The steam produced within the pressure-relief receptacle when relieving the pressure from this receptacle can immediately be used for preheating purposes within the preheating means provided with the pressure lock, noting that the hot water separated within the preheating means—which comprises in an advantageous manner a sieve drum equipped with a rotational drive means—can be introduced via pressure valves into the collecting receptacle for residual steam.

The residual steam of the waste water, which steam has been obtained from the collecting receptacle for residual steam, can be supplied onto the wet sieve and there be utilized again for preheating purposes.

A dust removal means can be connected to the subsequent drying means to be in the position to discharge a dry coal being as far as possible free of dust.

On account of the waste water and the steam obtained by pressure-relief being, according to the invention, recycled along a closed circuit, waste water is discharged from the process at only one single location located downstream of the wet sieve. It is only the waste water discharged at this location which requires a waste water treatment, while all other components of the plant are operated either in a completely closed condition or in a condition establishing a connection with the surroundings via a dust removal means.

In the following the invention is further illustrated with reference to an embodiment shown in the annexed drawing.

The raw brown coal is extracted from a storage bunker 1, is supplied onto a first conveyor 2 designed as a vibrating trough and is sprayed with hot water supplied via a conduit 3. The coal can thus be preheated to temperatures of approximately 40° C. to 60° C. The preheated coal is subsequently supplied onto a wet sieve 4, thereby supplying via a conduit 5 residual steam and optionally waste water coming from the waste water or, respectively, the vaporous atmospheres. The charged material is thus further preheated.

The overflow of the sieve has a granulometry of 3 to 40 mm and is charged onto a steep conveyor belt 6 and arrives at a preheating means 8 via a pressure lock 7 designed as a rotating pressure lock. Within the interior of the preheating means 8, there is arranged a sieve drum 9, the drive means of which is designated by 10. A conduit 11 for steam and a conduit 12 for waste water is connected to the preheating means 8. The preheating means 8 is connected with the autoclave 14 via a pressure lock 13 again being designed as a rotating pressure lock. Within the autoclave 14 there is again arranged a sieve drum 15 having associated thereto a rotational drive means 16. A conduit 17 for saturated steam as well as a waste water conduit 18 is connected to the autoclave 14.

Within the preheating means, the coal is preheated at a pressure of 15 bar up to maximum temperatures of 200° C. and is preferably maintained in a temperature range between 120° C. and 150° C. Within the autoclave 14, the drying process proper takes place by subjecting the coal, in dependence on the type of coal and on the desired degree of drying, with saturated steam and optionally with hot steam or superheated steam, respectively, at pressures up to 45 bar. Discharging is again effected via a pressure lock, which is designed as a cell wheel pressure lock and is designated by 19. A subsequent drying means 20 is connected to this cell wheel pressure lock 19 for subjecting therein the coal to the action of preheated air and for effecting a subsequent evaporation. The subsequent drying means 20 is designed as a vibrating drying means and is connected with a dust removal means via a conduit 21. The hot air is supplied via a conduit 22. Discharging of the dried coal is effected by means of a conveyor 23.

In a particularly advantageous manner, drying within the autoclave can be effected with superheated steam, thereby selecting the degree of superheating the steam such that the condition of saturation is obtained by the subsequent evaporation of water expelled from the coal. When operating the process in this manner, fresh water for steam generation and energy for generating the steam can be saved and the amount of condensate is reduced so that also the amount of waste water to be subsequently treated is reduced. Utilization of superheated steam is simplified by previously preheating the coal with steam under pressure and it is only required to consider the water content of the coal after having preheated the coal.

The waste water conduit 18 is connected with appending receptacles 24. The water expelled from the coal and the condensate produced from the supplied saturated steam is collected within these appending receptacles. Any generated $CO_2$ is exhausted via a conduit 25. Any solid matter is discharged via sludge conduits 26. The hot waste water is transferred into a pressure-relief receptacle 28 via conduits 27. Within this pressure-relief receptacle 28, the pressure is reduced, which results in steam recovery. The hot waste water is supplied to a preheating means 29 for the hot air required in the drying means 20 and later arrives at a collecting receptacle 31 for residual steam via a conduit 30. The residual steam collected within this collecting receptacle 31 is supplied to the wet sieve 4 via the conduit 5, while the remaining portion of hot waste water is recycled to the conveyor means 2 via the conduit 3. Excessive waste water is supplied to a waste water treatment stage via a conduit 32.

The steam coming from the pressure-relief receptacle 28 is supplied to the preheating means 8 via a conduit 33. The condensate derived from this preheating means 8 and being discharged via the conduit 12 can be combined with the waste water which is supplied via the conduit 30 to the collecting receptacle 31 for residual steam.

The saturated steam to be introduced into the autoclave 14 is, in an advantageous manner, blown from above onto the outer side of the mantle of the sieve drum by means of nozzles producing a flat jet, thus simultaneously making sure that the mantle of the sieve drum becomes not clogged. The sieve drums used are primarily slotted sieve drums. When treating coal of a granulometry from 3 to 40 mm, drying means comprising sieve drums can be operated with degrees of admission up to 60% of their volumetric capacity and a throughput up to 60 metric tons per hour and per sieve drum dryer can easily be obtained in the plant shown in the drawing. The residence time of the coal within the autoclave 14 is selected in dependence on the grain size and can be selected shorter for small grain sizes than for greater grain sizes. The established typical values for the residence time are 5 min for grain sizes ranging from 5 to 20 mm, 10 min for grain sizes ranging from 10 to 30 mm and 20 min for grain sizes ranging from 20 to 40 mm.

What is claimed is:

1. A drying plant for brown coals of high water content, in which plant the coal to be dried is preheated, is steamed by using steam under super-atmospheric pressure and is redried, characterized by the combination of the following parts:

(a) first conveyor means including a vibrating trough and means for spraying hot waste water over the coal on the vibrating trough, (b) a vibrating wet sieve for receiving coal from the first conveyor means and for supplying residual steam to the coal on the sieve, (c) second conveyor means including a steep conveyor belt for receiving sieved material from the wet sieve and for transporting the sieved material to a pressure lock, (d) preheating means associated with said pressure lock for receiving material therefrom, said preheating means having connections for steam conduits, said preheating means and said pressure lock being equipped with infinitely variable drive means, (e) a further pressure lock equipped with infinitely variable drive means for discharging the coal from the preheating means and for charging the coal into an autoclave designed for being supplied with steam, said preheating means having waste water discharge conduits connected thereto, (f) a sieve drum arranged within the autoclave and comprising a rotational drive means and conveying elements, (g) a further pressure lock for discharging the steamed material, (h) a subsequent drying means for receiving steamed coal from said further pressure lock, said subsequent drying means including a connection for preheated gases such as steam, air or inert gases, (i) means for transporting away the dry coal.

2. A drying plant as in claim 1 including waste water conduits coming from the autoclave and connected to appending receptacles, to which are connected discharge conduits for $CO_2$, for waste water and for sludge as well as a conduit leading to a pressure-relief receptacle.

3. A drying plant as in claim 2 including a conduit connected between the pressure relief receptacle and the preheating means for transmitting pressure-relieved steam to the latter.

4. A drying plant as in claim 2 including means for supplying hot waste water from the pressure-relief receptacle to a heat exchanger for preheating drying air and means for supplying residual steam from a collecting receptacle for residual steam, which collecting receptacle is connected with the heat exchanger, to the wet sieve.

5. A drying plant as in claim 4 wherein said means for spraying hot water over the coal on the first conveyor means includes means for transferring hot waste water from said collecting receptacle.

6. A drying plant as in claim 4 wherein the preheating means comprises a sieve drum equipped with a rotational drive means and wherein separated hot water is supplied via pressure valves to said collecting receptacle.

* * * * *